United States Patent [19]

Lichtblau

[11] 4,117,466

[45] Sep. 26, 1978

[54] BEAT FREQUENCY INTERFERENCE REJECTION CIRCUIT

[76] Inventor: George Jay Lichtblau, 13 Tannery Hill Rd., Ridgefield, Conn. 06810

[21] Appl. No.: 777,524

[22] Filed: Mar. 14, 1977

[51] Int. Cl.[2] ..... G08B 13/24; G08B 29/00

[52] U.S. Cl. ..... 340/501; 340/572

[58] Field of Search ..... 340/280, 258 C; 325/477

[56] References Cited

U.S. PATENT DOCUMENTS

| | | | |
|---|---|---|---|
| 3,818,472 | 6/1974 | Mauk et al. | 340/258 C |
| 3,868,669 | 2/1975 | Minasy | 340/280 |

*Primary Examiner*—Glen R. Swann, III

*Attorney, Agent, or Firm*—Weingarten, Maxham & Schurgin

[57] ABSTRACT

A beat frequency interference rejection circuit operative in an electronic security system to inhibit the provision of an alarm indication for the duration of beat interference caused by an interfering transmitter. A high pass filter is employed having a cut-off frequency which substantially blocks all frequency components produced by a resonant tag circuit while passing frequency components caused by the beat processing. The high pass filter signal is processed to produce an inhibit signal to inhibit alarm production in the presence and for the duration of the beat interference.

10 Claims, 3 Drawing Figures

BEAT FREQUENCY INTERFERENCE REJECTION CIRCUIT

FIELD OF THE INVENTION

This invention relates to electronic security systems and more particularly to circuitry therefore to reject beat frequencies caused by an interfering transmitter signal.

BACKGROUND OF THE INVENTION

An electronic security system is described in U.S. Pat. Nos. 3,180,147 and 3,863,244 for detection of the unauthorized removal of items containing a resonant tag circuit. Such system employs a transmitter providing a repetitively swept range of frequencies driving an antenna which generates a swept electromagnetic field in a zone under surveillance. A resonant tag includes a circuit resonant at a frequency within the swept band and operative in response to the applied field to resonate at its characteristic frequency which is sensed by the receiver portion of the system and processed to provide an output alarm indication of tag presence in the surveillance zone. The receiver includes signal discrimination circuits for distinguishing between an actual tag and spurious signals which could be falsely detected as a tag and therefore cause a false alarm. Preferred signal processing techniques for such electronic security systems are shown in the above-cited patents.

A source of interference is sometimes present in the vicinity of a security system such as described above, which has not been distinguishable by the system from a resonant tag signal. The source of this type of interference is a fixed frequency transmitter producing a signal which beats with the swept frequency of the security system transmitter to cause a beat frequency signal which appears substantially the same as a true tag signal to the signal processing circuits of known systems. As a result, the spurious signal produced by the fixed frequency transmitter is not discriminated against and a false alarm may result.

SUMMARY OF THE INVENTION

In accordance with the present invention, beat frequency signals caused by an interfering transmitter are separately detected and employed to inhibit the security system for the duration of the beat interference, which is usually a small portion of the sweep time of the system transmitter. Resonant tags tuned to frequencies other than that of the interfering transmitter are still detectable by the security system.

The beat signal caused by interference of an interfering transmitter and the system transmitter contains frequency components which extend from substantially zero frequency up to at least two times the interfering signal frequency, while frequency components of the resonant tag will not extend as high due to the inherently limited Q of the tag circuit. A high pass filter is provided which has a cut-off frequency sufficiently high to substantially block all frequency components produced by the resonant tag while passing frequency components caused by the beat process. This high pass filter is coupled to the security system detector to receive output signal therefrom and in response to an interfering beat to provide a signal for inhibiting the alarm for the duration of the beat interference.

DESCRIPTION OF THE DRAWINGS

The invention will be more fully understood from the following detailed description taken in conjunction with the accompanying drawings in which.

DETAILED DESCRIPTION OF THE INVENTION

Figure 1:
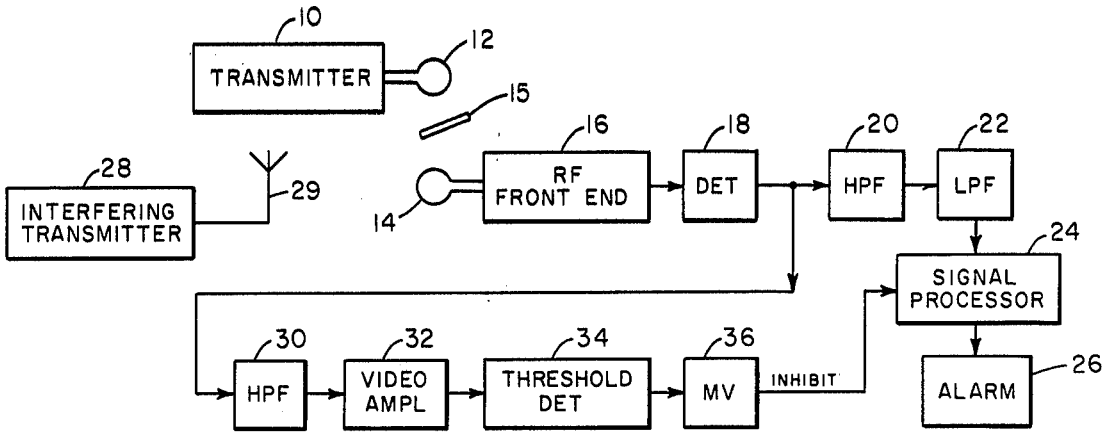
FIG. 1 is a block diagram representation of an electronic security system employing the invention.

An electronic security system is shown in FIG. 1 and includes a transmitter 10 coupled to an antenna 12 operative to provide an electromagnetic field within a predetermined area to be controlled and which is repetitively swept over an intended frequency range. A receiving antenna 14 at the controlled area receives energy electromagnetically coupled from antenna 12 and is coupled to an RF front-end 16 which includes an RF band pass filter and RF amplifier. The output of the front-end 16 is applied to a detector 18, the output of which is coupled to a high pass filter 20 which is effective to pass only the higher frequency portion of the signal spectrum. The output of filter 20 is applied to a low pass filter 22 which is effective to remove carrier frequency components and high frequency noise. The output of filter 22 is applied to a signal processor 24 which includes noise rejection circuitry operative to discriminate intended signals from noise and to provide an output signal representative of the presence of a resonant tag circuit 15 in the controlled area. Such output signals are applied to an alarm 26 or other output utilization apparatus to denote detection of a resonant tag in the controlled area. This system just described is the subject of the above-identified U.S. patents and is operative to detect tag presence in a controlled area and to provide an alarm indication thereof.

An interfering transmitter 28 and associated antenna 29 located in the vicinity of the security system produces a fixed frequency carrier within the swept frequency range of transmitter 10 and which can beat with the signal from transmitter 10 as it sweeps past the frequency of transmitter 28. In accordance with this invention, beat frequency signals caused by interfering transmitter 28 are discriminated against to prevent a false alarm in the presence of such interfering signals. The output signals from detector 18 are applied to a high pass filter 30 which has a cut-off frequency sufficiently high to substantially block all frequency components produced by the resonant tag circuit 15, while passing frequency components caused by the beat interference between the signals from transmitter 10 and interfering transmitter 28. The output signal from filter 30, which is representative of the beat note interference, is coupled via a video amplifier 32 to a threshold detector 34. The threshold detector includes a reference threshold defining a signal level below which no inhibiting signal is produced or needed by reason of the small interfering signal levels. Upon exceedance of the threshold level by the signals from video amplifier 32, the threshold detector 34 provides a signal to multivibrator 36 which provides an inhibit pulse of fixed duration, the duration corresponding to the duration of the beat frequency signal produced by beating of the fixed frequency signal of interfering transmitter 28 and the swept frequency signal from transmitter 10. The inhibit pulse is provided to signal processor 24 for the purpose of preventing alarm actuation in the presence of such inhibit pulse. Thus, the system is inhibited from producing a false alarm for the duration of the beat interference.

Figure 2A:
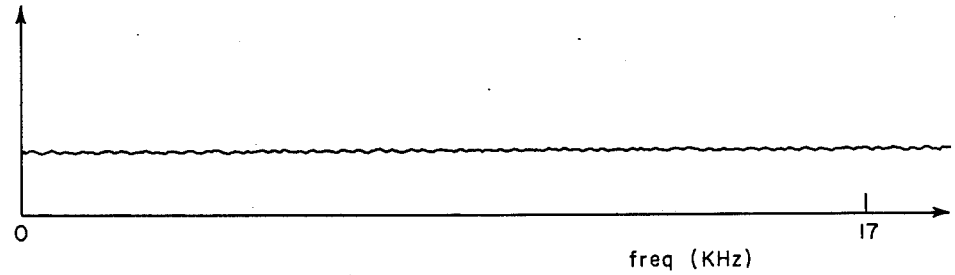
FIGS. 2A and 2B are plots of the frequency spectrum of a beat frequency signal and a resonant tag signal respectively, useful in illustrating operation of the invention.
Figure 2B:
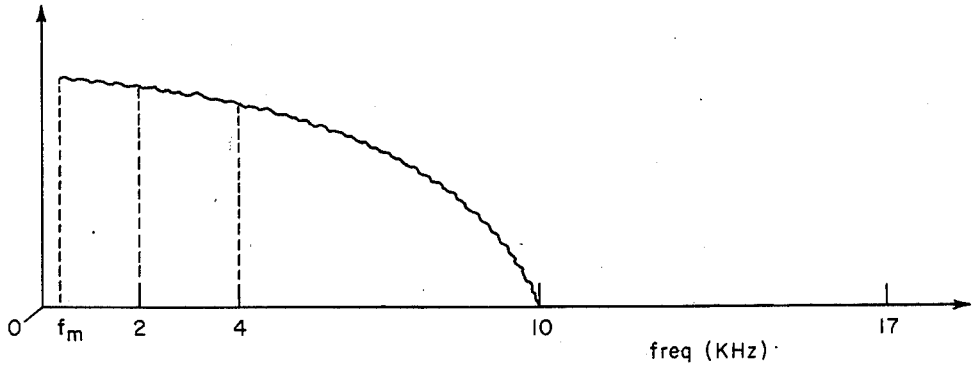

The frequency spectrum of the beat frequency interference is depicted in FIG. 2A and is of generally uniform amplitude over a broad frequency range extending from zero frequency up to a minimum of twice the carrier frequency of interfering transmitter 28. The frequency spectrum provided by the resonance of tag 15 is illustrated in FIG. 2B and is seen to extend from the modulation frequency $f_{mm}$ and to decrease in amplitude with increasing frequency, with the higher frequency components of the tag spectrum being much less than the higher frequency components present in the interfering frequency spectrum shown in FIG. 2A. The high pass filter 30 is provided to have a cut-off frequency above which no significant frequency components are present due to the tag circuit. In the illustrated embodiment, the tag circuit has a high frequency limit of 10 kHz. The cut-off frequency of filter 30 is 17 kHz which substantially blocks all signals produced by the resonant tag while passing frequency components produced by the beat interference.

The processing of the inhibit pulse from multivibrator 36 to prevent energizing of alarm 26 can be accomplished by well known circuitry which typically would include a gate circuit operative in the presence of the inhibit pulse to prevent application of an energizing signal to alarm 26. It will be appreciated that the inhibit signal derived from high pass filter 30 can be produced by different circuit means other than that illustrated. Preferably but not necessarily the inhibit signal should be of fixed duration to minimize the effects caused by the bandwith of the inhibit signal channel.

The invention is not to be limited by what has been shown or described except as what has been indicated in the appended claims.

What is claimed is:

1. For use in an electronic security system having a transmitter producing an electromagnetic field at a frequency repetitively swept through a predetermined range, a resonant tag of resonant frequency within the swept range and receiver means to detect any resonant frequency of the tag produced by the swept field and to provide an alarm indication thereof, an interference rejection circuit for discriminating between a resonant tag signal and a spurious signal produced by a fixed frequency transmitter having a frequency within the swept range, said circuit comprising:

means operative in response to the detector output signal from said receiver means to detect beat frequencies caused by interference of the swept transmitter frequency and said fixed frequency of an interfering transmitter; and means operative upon such detection to produce a signal to inhibit said alarm indication for the duration of the beat interference.

2. The invention of claim 1 wherein said beat frequency detection means includes high pass filter means having a cut-off frequency sufficient to substantially block all frequency components produced by the resonant tag while passing frequency components caused by the beat interference.

3. The invention of claim 2 wherein said alarm inhibiting means includes circuit means operative in response to the output signal from said high pass filter means to produce an inhibit signal of a duration corresponding to the duration of the beat interference.

4. An electronic security system comprising:

transmitter means for providing an electromagnetic field in a predetermined area at a frequency repetitively swept through a predetermined range;

a resonant tag circuit having at least one resonant frequency within the predetermined range of frequencies;

receiver means for detecting the presence of said at least one resonant frequency from a tag circuit present in the predetermined area;

means for providing an output indication of alarm actuation in response to a signal from said receiver means;

means operative in response to the detector output signal from said receiver means to detect beat frequencies caused by interference between the swept frequency of said transmitter means and a fixed frequency within said swept range produced by an interfering transmitter; and means operative upon such detection to produce a signal to inhibit said alarm indication for the duration of the beat interference.

5. The invention of claim 4 wherein said beat frequency detection means includes high pass filter means having a cut-off frequency sufficient to substantially block all frequency components produced by the resonant tag while passing frequency components caused by the beat interference.

6. The invention of claim 5 wherein said inhibit signal producing means includes:

threshold means operative in response to a signal from said high pass filter means of a magnitude above a predetermined threshold level to produce an inhibit signal.

7. The invention of claim 5 wherein said inhibit signal producing means includes:

threshold means operative in response to a signal from said high pass filter means of a magnitude above a predetermined threshold level to produce a signal;

circuit means operative in response to the signal from said threshold means to provide an inhibit pulse of fixed duration corresponding to the duration of the beat frequency signal produced by beating of the interfering transmitter signal and the swept signal of said transmitter means.

8. An electronic security system comprising:

transmitter means for providing an electromagnetic field in a predetermined area at a frequency repetitively swept through a predetermined range;

a resonant tag circuit having at least one resonant frequency within the predetermined range of frequencies;

receiver means for detecting the presence of said at least one resonant frequency from a tag circuit present in the predetermined area;

means for providing an output indication of alarm actuation in response to a signal from said receiver means;

means operative in response to the detector output signal from said receiver means to detect beat frequencies caused by interference between the swept frequency of said transmitter means and a fixed frequency within said swept range produced by an interfering transmitter; and means operative upon such detection to produce an output signal indication of beat interference.

9. For use in an electronic security system having means for providing in a surveillance zone an electromagnetic field of a frequency which is repetitively swept within a predetermined range, means for detecting the presence of a resonant tag circuit having a resonant frequency within said range, and means for actuating an alarm in the presence of said resonant tag circuit in the surveillance zone, an interference rejection circuit for discriminating between a signal indicating the presence of a resonant tag circuit in the surveillance zone and spurious signals produced by a fixed frequency transmitter having a frequency within said predetermined range comprising:

means operative in response to beat frequency signals produced by the fixed frequency transmitter signal and the swept frequency signal beating in the security system demodulator to provide a beat note signal representative of such beat frequency interference; and means operative in response to said beat note signal to inhibit the alarm of said security system for the duration of the beat note signal.

10. The invention of claim 9 wherein said beat note signal means includes a high pass filter having a cut-off frequency sufficiently high to substantially block all frequency components produced by the resonant tag circuit while passing frequency components caused by the beat interference.

* * * * *